United States Patent [19]

Laughter

[11] 4,031,382

[45] June 21, 1977

[54] LUMINAIRE ASSEMBLY

[75] Inventor: Clifford M. Laughter, Hendersonville, N.C.

[73] Assignee: General Electric Company, New York, N.Y.

[22] Filed: June 24, 1976

[21] Appl. No.: 699,737

[52] U.S. Cl. ..... 240/25; 240/147

[51] Int. Cl.[2] ..... F21S 1/10; F21S 3/10; F21S 13/10

[58] Field of Search ..... 240/25, 146, 147, 41.55, 240/51.11 R

[56] References Cited

UNITED STATES PATENTS

| | | | |
|---|---|---|---|
| 2,778,929 | 1/1957 | Loehr | 240/147 X |
| 2,840,690 | 6/1958 | Harling | 240/25 |
| 2,974,219 | 3/1961 | Husby | 240/25 |
| 3,561,682 | 2/1971 | Rex | 240/25 |
| 3,590,238 | 6/1971 | Arens | 240/25 |

*Primary Examiner*—John Gonzales
*Attorney, Agent, or Firm*—Sidney Greenberg

[57] ABSTRACT

Device for hingedly attaching luminaire globe to ballast housing. Ring member extending around the rim of the globe has a plurality of hooks detachably engaged by latches on the ballast housing. One of the hooks is constructed to captively hinge the globe to the housing.

9 Claims, 6 Drawing Figures

LUMINAIRE ASSEMBLY

The present invention relates to luminaires, and particularly concerns an improved device for detachably securing a luminaire globe to a supporting housing.

It is an object of the invention to provide an improved device for detachably and hingedly securing a luminaire globe to its supporting housing.

It is another object of the invention to provide a sealed assembly of a luminaire housing and globe of the above type which enhances the appearance of the luminaire, is low in cost, comprises a minimum of parts, and facilitates detachment of the globe from the housing for servicing operations.

Other objects and advantages will become apparent from the following description and the appended claims.

With the above objects in view, the present invention in one of its aspects relates to a luminaire comprising, in combination, a housing having an open bottom, a plurality of latches circumferentially secured to the housing, a globe having an open top arranged closing the open bottom of the housing, the globe having an outwardly projecting rim extending around its open top, a ring member extending around the globe in engagement with the underside of the rim, the ring member having a plurality of circumferentially spaced hooks detachably engaged by the latches, and means associated with one of the hooks for retaining the latch in engagement with the latter hook, whereby the latter hook with associated latch serves to captively hingedly secure the globe to the housing.

The invention will be better understood from the following description taken in conjunction with the accompanying drawing, in which.

Figure 1:
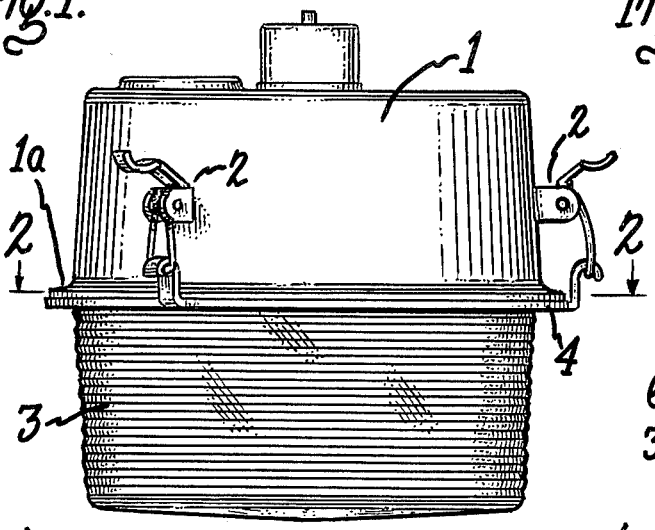
FIG. 1 is a view in elevation of a luminaire assembly embodying the present invention.
Figure 6:
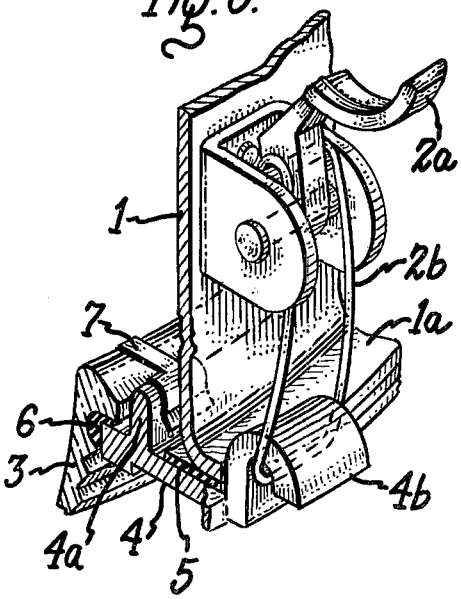
FIG. 6 is a perspective view of the assembly shown in FIG. 3.

Referring now to the drawing, and particularly to FIG. 1, there is shown a luminaire of the type incorporating a gaseous discharge lamp (not shown) and comprising an upper housing 1 containing electrical ballast components (not shown) for operating the lamp. The housing has an open bottom surrounded by flange 1*a* and has secured thereto a plurality of uniformly circumferentially spaced latches 2 of conventional type having operating lever 2*a* and U-shaped latch spring 2*b* (see FIG. 6).

Figure 3:
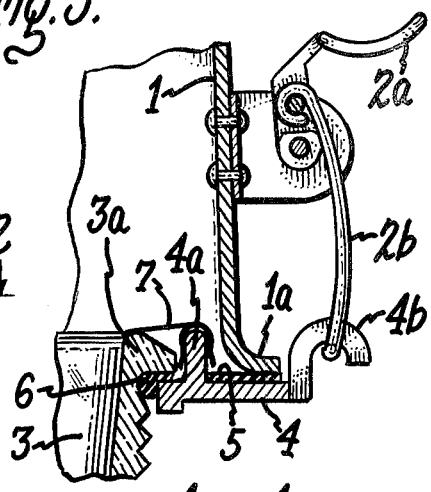
FIG. 3 is an enlarged detail view showing the assembly of the luminaire parts at one of the attaching ring hooks.

Arranged closing the open bottom of housing 1 is a bowlshaped globe or refractor 3 of light transmitting material such as glass or plastic formed with a flange or rim 3*a* (see FIG. 3) extending around its open top. A connecting ring 4 typically made of aluminum is mounted extending around globe 3 with its inner portion underlying rim 3*a* and its outer portion projecting radially from the globe. In the assembly, as seen in FIG. 3, bottom flange 1*a* of housing 1 rests on the top surface of ring 4 with an intervening sealing gasket 5, and globe rim 3*a* rests on the surface of the inner part of ring 4 with intervening sealing gasket 6, the latter preferably being of adhesive type. To retain connecting ring 4 in assembly with globe 3, a plurality of Tinnerman clips 7 or other similar fastening means are arranged engaging an annular ridge 4*a* extending upwardly from the surface of ring 4 near its inner edge, the clips resiliently bearing at their opposite ends against the top of rim 3*a* of globe 3.

Figure 2:
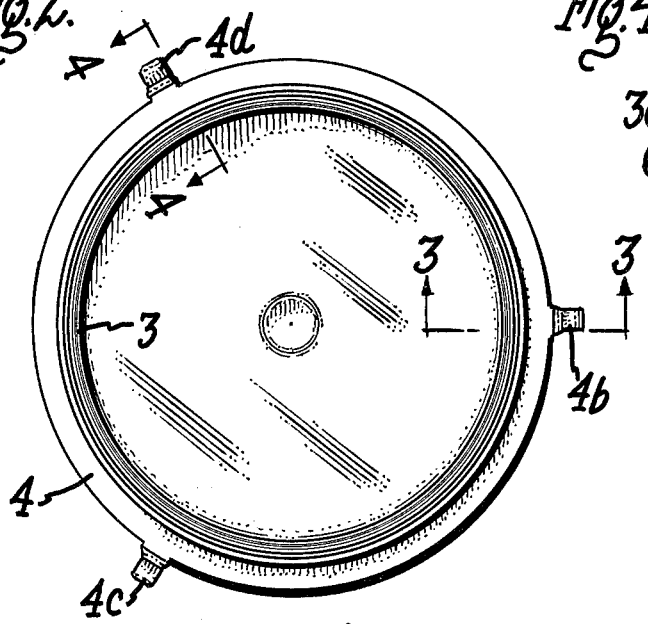
FIG. 2 is a top view of the luminaire globe and attaching ring as viewed along the line 2—2 of FIG. 1.
Figure 4:
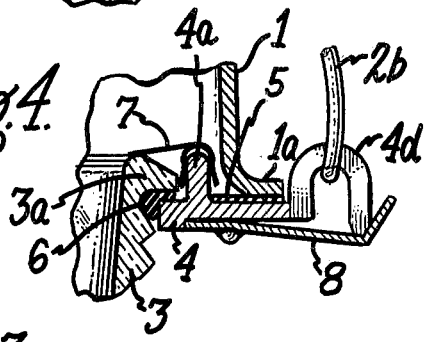
FIG. 4 is a similar view showing the assembly at the hinging hook.
Figure 5:
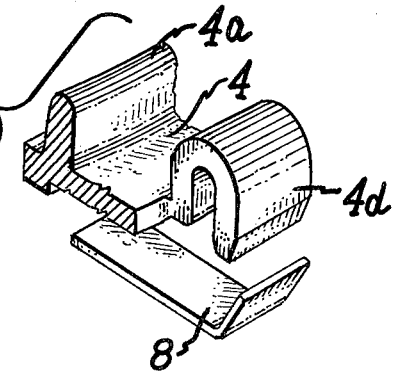
FIG. 5 is an exploded view of a portion of the hinging hook assembly.

Connecting ring 4 is formed at circumferentially spaced points on its outer edge with a plurlity of hooks, preferably three hooks 4*b*, 4*c*, and 4*d* (see FIG. 2), which are arranged to be engaged by the latch springs of the respective latches 2. In accordance with a feature of the invention, two of the hooks 4*b*, 4*c* have a partial U-shaped form as shown in FIG. 3 wherein the outer arm of each hook is spaced substantially above the plane of the main portion of ring 4, while the remaining hook 4*d*, as seen in FIG. 4, has a full U-shaped form. In a preferred embodiment, the outer arm of hook 4*d* extends downwardly slightly below the plane of the bottom surface of ring 4, for reasons explained below.

Secured to the bottom surface of ring 4 by a rivet or the like is a retaining clip 8 in the form of a spring metal strip which bridges the opening of hook 4*d* and has an upwardly angled outer end which engages the outer edge of hook 4*d*. Due to the extra length of the outer arm of the latter hook, spring clip 8 is bent slightly downward as seen in FIG. 4 so that it is constantly urged into yieldable engagement with the bottom of the outer hook arm and thereby captively holds latch spring 2*b* within hook 4*d*. Thus, while hooks 4*b*, 4*c* are so formed as to facilitate engagement and disengagement of the corresponding latch springs relative thereto, hook 4*d* is so constructed that upon detachment of the latches from the other two hooks, hook 4*d* with associated clip 8 serves as a captive hinge to allow globe 3 to swing downwardly and thereby provide access to the interior of the luminaire while the globe hangs safely in hinged connection with ballast housing 1. Globe 3 with attached ring 4 may be entirely removed simply by bending spring clip 8 a sufficient distance away from the hook opening to allow latch spring 2*b* to be removed from the hook.

The described arrangement is such that when globe 3 is swung upwardly about its hinged attachment into closed position and latched in place, a substantially air-tight seal is provided between the assembled parts to prevent entry of water and dust into the interior of the luminaire. In addition, a neat and clean appearance of the joint between the ballast housing and the globe is afforded.

While the present invention has been described with reference to a particular embodiment thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire comprising, in combination, a housing having an open bottom, a plurality of circumferentially spaced latches secured to said housing, a globe having an open top arranged closing the open bottom of said housing, said globe having an outwardly projecting rim extending around its open top, a ring member extending around said globe engaging the underside of said rim, said ring member having a plurality of circumferentially spaced hooks respectively detachably engaged by said latches, and means associated with one of said hooks for retaining the latch in engagement with said one hook whereby the latter hook with associated latch captively hingedly secures said globe to said housing.

2. A luminaire as defined in claim 1, said one hook having an opening for passage of its associated latch, said retaining means comprising a spring member secured to said ring member and yieldably closing said hook opening.

3. A luminaire as defined in claim 2, said ring member having a surface extending in a plane, said spring member secured to and extending along said surface, said one hook having an outer arm extending downwardly beyond said surface and engaging said spring member.

4. A luminaire as defined in claim 3, the remainder of said hooks having an outer arm termination in a plane above said plane of said ring member surface.

5. A luminire as defined in claim 1, including three uniformly spaced latches and three correspondingly spaced hooks.

6. A luminaire as defined in claim 5, each of said hooks being generally U-shaped with an inner and an outer arm, the outer arm of said one hook being longer than its inner arm, said retaining means comprising spring means engaging said outer arm and yieldably closing the opening of said one hook.

7. A luminaire as defined in claim 6, the outer arms of the remaining two hooks being shorter than their inner arms.

8. A luminaire as defined in claim 1, said ring member having inner and outer edges, said hooks formed at the outer edge thereof, said ring member having an upper bearing surface intermediate said inner and outer edges, said housing having a flange extending around its open bottom and mating with said bearing surface of said ring member.

9. A luminaire as defined in claim 8, including clip means mounted on said ring member adjacent the inner edge thereof and engaging the rim of said globe for holding said ring member in assembly with said globe.

* * * * *

UNITED STATES PATENT OFFICE

CERTIFICATE OF CORRECTION

PATENT NO. : 4,031,382

DATED : June 21, 1977

INVENTOR(S) : Clifford M. Laughter

It is certified that error appears in the above-identified patent and that said Letters Patent are hereby corrected as shown below:

Column 3, line 23, delete "termination" and substitute --terminating-- therefor.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*